US005101107A

United States Patent [19]

Stoot

[11] Patent Number: 5,101,107

[45] Date of Patent: Mar. 31, 1992

[54] CORONA CHARGING DEVICE

[75] Inventor: Andreas C. Stoot, Venlo, Netherlands

[73] Assignee: OCE Nederland B.V., Netherlands

[21] Appl. No.: 529,205

[22] Filed: May 25, 1990

[30] Foreign Application Priority Data

May 31, 1989 [NL] Netherlands ..... 8901371

[51] Int. Cl.[5] ..... G03G 15/02; H01T 19/04

[52] U.S. Cl. ..... 250/324; 355/224; 361/230

[58] Field of Search ..... 355/221, 224; 250/324, 250/325, 326; 361/230, 234

[56] References Cited

U.S. PATENT DOCUMENTS 3,396,308 8/1968 Whitmore ..... 250/324 X
3,691,373 9/1972 Compton et al. ..... 250/324 X
3,744,898 7/1973 Kurahashi et al. ..... 355/224
3,887,809 6/1975 Marx et al. ..... 250/324
4,227,233 10/1980 Nishikawa et al. ..... 250/324 X

*Primary Examiner*—Fred L. Braun
*Attorney, Agent, or Firm*—Reed Smith Shaw & McClay

[57] ABSTRACT

A corona device in which the ion-generating element is an array of pin electrodes which are secured to and insulated from a housing open on at least one side and profiled auxiliary electrodes disposed in the vicinity of the pin electrodes in a plane perpendicular to the possibly imaginarily lengthened pin electrodes. The imaginary connecting lines between the tops of the auxiliary electrodes pass substantially through the tops of the pin electrodes or the pin electrodes imaginarily lengthened in the direction of the open side.

4 Claims, 2 Drawing Sheets

CORONA CHARGING DEVICE

FIELD OF THE INVENTION

The invention relates to a corona device comprising a housing open on at least one side, an array of pin electrodes adapted to be separately or jointly connected to a voltage source and disposed in and electrically insulated from said housing, one free end of the pin electrodes being directed to the open side of the said housing, and auxiliary electrodes on both sides of said array of pin electrodes.

BACKGROUND OF THE INVENTION

Corona devices with pin electrodes are well known. See, for example, U.S. Pat. No. 3,744,898; Research Disclosure No. 184, Aug. 1979, p. 428 ( 18444) and European Patent Application 0 274 895 Al (comb electrode). These devices are used, for example, for charging a photoconductive element in an electro-photographic dsevice, or for creating a field required tro transfer a powder image from the photoconductive element to a receiving material. On connection to a high voltage each pin electrode generates an ion cloud which extends from the pin electrode to a counter electrode. A material to be charged, e.g. a photoconductive element, is situated between the pin electrodes and the counter electrode.

A disadvantage of such corona devices is that the ion clouds repel one another so that a non-uniform charge pattern may occur on the material to be charged.

A pin electrode corona device having an array of pins and auxiliary electrode is disclosed in Netherland Application NL-A-294832. This application describes a corona device in which a strip-shaped auxiliary electrode is disposed on either side of and parallel to an array of pin electrodes. Charge uniformity is improved by the use of such auxiliary electrodes in the vicinity of the pin electrodes. This use, however, in turn has the disadvantage that the charging speed is reduced. Accordingly, it is an object of the present invention to provide improved auxiliary electrodes which overcome this disadvantage.

SUMMARY OF THE INVENTION

The present invention provides a corona device in which the auxiliary electrodes are disposed in a plane perpendicular to the plane in which the array of pin electrodes lies. The auxiliary electrodes are profiled along both sides of the electrode housing and towards the pin electrodes. Further, an imaginary connecting line between each top of the auxiliary electrode on one side of the array of pin electrodes and the nearest top of the auxiliary electrode on the other side of the array of pin electrodes passes substantially through a top of the array of the pin electrodes or through the plane of the array. Using a corona device according to the invention the material to be charged can be given a charge in which the uniformity is greatly improved even at high charging speeds.

Other features and advantages of the invention will be apparent from the following description of the presently preferred embodiments taken in connection with the accompanying drawings.

Figure 4:
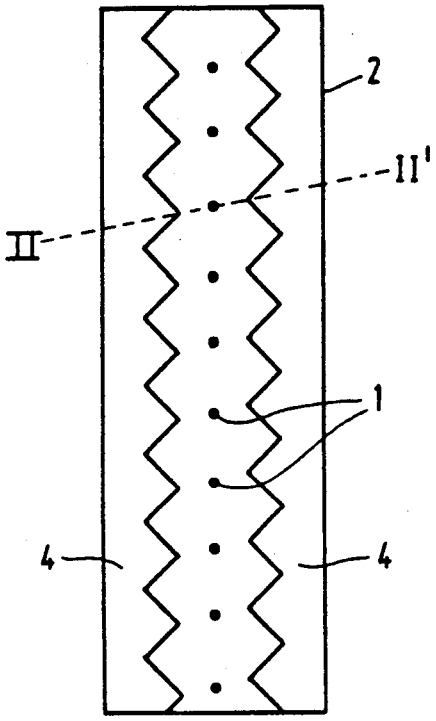
Figure 5:
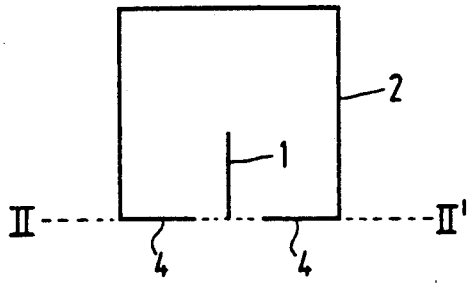
Figure 6:
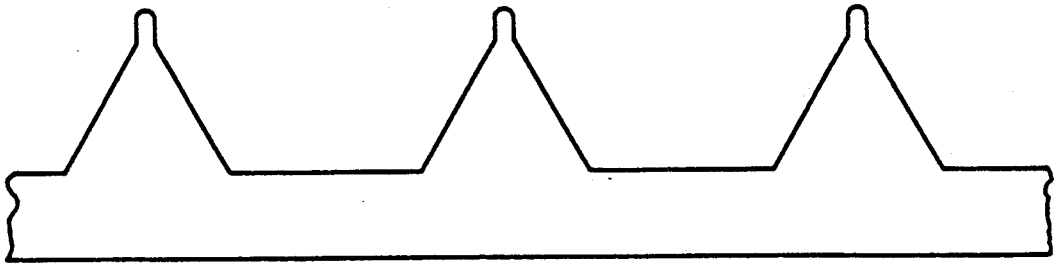

FIGS. *3a—3e* each diagrammatically illustrate another embodiment of an auxiliary electrode;

FIG. 4 is a diagrammatic bottom view of a second embodiment of the corrona device according to the invention;

FIG. 5 is a diagrammatic cross-section taken along line II—II' of FIG. 4; and FIG. 6 is a diagrammatic embodiment of an array of pin electrodes to be used in a corona device according to the invention.

PRESENTLY PREFERRED EMBODIMENTS

Figure 1:
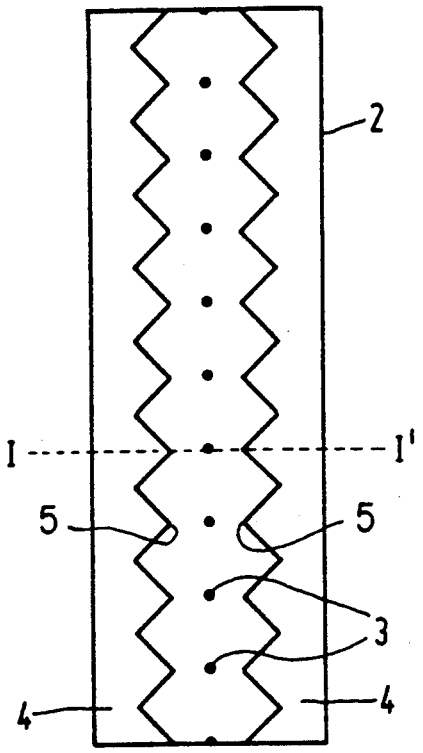
FIG. 1 is diagrammatic bottom view of a first embodiment of the corona device according to the invention.
Figure 2:
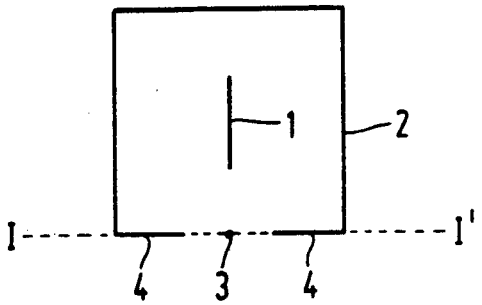
FIG. 2 is a diagrammatic cross-section along line I—I' of FIG. 1.

An embodiment of the coroma device represented in bottom view in FIG. 1 and in cross-section in FIG. 2 comprises an array of pin electrodes 1 in a box-shaped housing 2 open on one side. The pin electrodes are directed towards the open side of the housing 2. Brass auxiliary electrodes 4 are disposed on the open side of the housing 2 on either side of and in a plane perpendicular to the array pin electrodes 1 and have a saw-tooth profile. The shortest distance between these auxiliary electrodes 4 at projections 3 of pin electrodes 1 in the plane of the auxiliary electrodes 4 being smaller than the distance between the auxiliary electrodes 4 in said the zone between projections 3 of pin electrodes 1 in said plane, and tops 5 of the auxiliary electrodes 4 near the projections 3 of the pin electrodes 1 being directed towards one another. The distance between the tops of pin electrodes 1 and the plane through the auxiliary electrodes 4 is about 15 mm. The smallest distance between the facing tops 5 of the auxiliary electrodes 4 at earth potential is about 12 mm. The maximum distance, in this case, between the auxiliary electrodes 4 in the zone between projections 3 is 22 mm. In this embodiment the distance between the pin electrodes 1 is about 4 mm. The distance between the adjacent tops 5 of auxiliary electrodes 4 is also about 4 mm.

In alternative embodiments of the corona device according to the invention, auxiliary electrodes 4 can be profiled in other ways, e.g., with rounded or sharp tops. FIGS. *3a—3e* show some profile shapes. It should be apparent to those skilled in the art that several shapes are usable in a corona device according to the invention and that the invention is not restricted to the shapes indicated in these Figures. The choice of a specific shape depends, inter alia, on the charging speed required, the requirements in respect of charge uniformity, the current intensity through the pin electrodes and the distance between the pin electrodes. The distance between the auxiliary electrodes 4 and the distance between the tops of the pin electrodes 1 and the plane through the auxiliary electrodes 4 may also be adapted. The auxiliary electrodes 4 can be made from brass, nickel, steel or any other suitable conductive material. The auxiliary electrodes are generally at earth potential but may also be connected to a voltage source.

In another embodiment of the corona device according to the invention represented in bottom plan view in FIG. 4 in a cross-section in FIG. 5 on the line II—II', auxiliary electrodes 4 are disposed in a palne perpendicular to the pin electrodes 1 and on either side of the tops of these pin electrodes 1, auxiliary electrodes 4 are offset from one another. The connecting lines between the closest tops of two auxiliary electrodes 4 in these conditions pass through the tops of pin electrodes 1. The smallest distance between the facing tops of the auxiliary electrodes 4 at earth potential is about 10 mm. The angle between the line II—II' and a line perpendicular to the pin electrode array is, in this case, about 11° and the distance between the pin electrode array and the housing 2 is at least 20 mm. The distance between the pin electrodes 1 in this embodiment is about 4 mm. The distance between adjacent tops 5 of the auxiliary electrodes 4 is also 4 mm.

Figure 3:
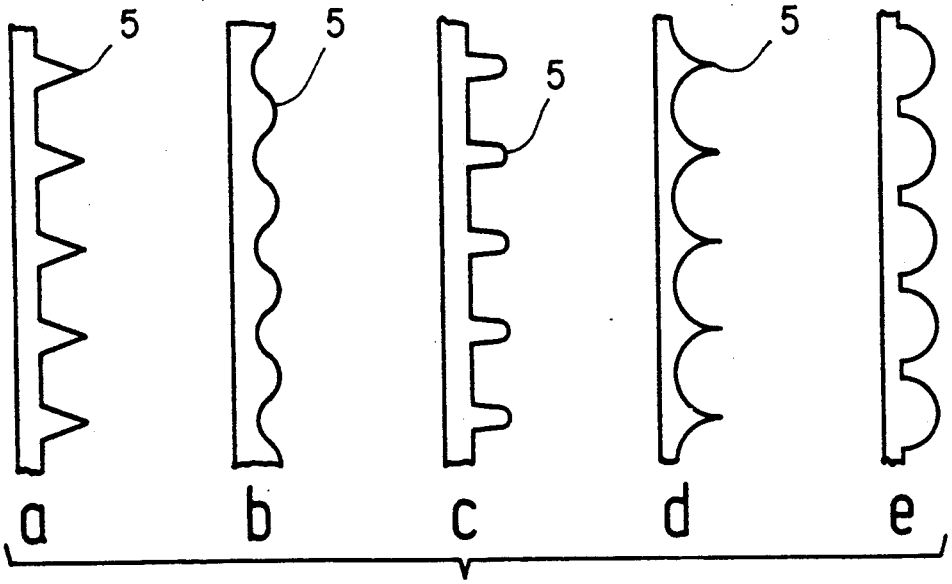

The pin electrode array may consist of a row of electrically conductively connected needles or a metal strip, having, for example, the shape of the auxiliary electrodes 4 in FIG. 1 or the auxiliary electrodes 4 shown in FIG. 3*a* or FIG. 3*d*.

In practice it has been found advantageous to use in the corona device according to the invention an array of pin electrodes having the point shape as shown in FIG. 6. The uniformity of the charge is further improved by means of a pin array of this kind which may, for example, be integrally electro-formed.

While presently preferred embodiments have been shown and described in particularity, the invention may be otherwise embodied with the scope of the appended claims.

What is claimed is:

1. A corona charging device comprising:

a housing open on at least one side;

an array of pin electrodes adapted to be separately or jointly connected to a voltage source and disposed in said housing so as to be electrically insulated therefrom, one free end of said pin electrodes being directed to the open side of said housing, said array lying in a plane passing through said opening; and auxiliary electrodes positioned on both sides of said array in a plane perpendicular to the plane of said pin electrodes, said auxiliary electrodes being profiled on the side directed towards the pin electrodes, each of said profiles having a top oppositely opposed from the other and lying on an imaginary connection line therebetween and passing substantially through a corresponding top of pin electrode or through a line extending from a pin.

2. A corona charging device according to claim 1, wherein said connecting lines between the tops of the auxiliary electrodes pass substantially through the plane of said pin electrodes and wherein the tops of the auxiliary electrodes are directed towards one another at points where said pin electrodes imaginarily intersect the plane of said auxiliary electrodes.

3. A corona charging device according to claim 1 or 2, wherein the tops of the auxiliary electrodes are rounded off.

4. A corona charging device according to claim 1 or 2, wherein the tops of the auxiliary electrodes are pointed.

* * * * *